US009683714B1

(12) United States Patent
Gunawan

(10) Patent No.: US 9,683,714 B1
(45) Date of Patent: Jun. 20, 2017

(54) BOOK LAMP WITH FLEXIBLE DIFFUSER SHADE

(71) Applicant: Max Dewanto Gunawan, San Francisco, CA (US)

(72) Inventor: Max Dewanto Gunawan, San Francisco, CA (US)

( * ) Notice: Subject to any disclaimer, the term of this patent is extended or adjusted under 35 U.S.C. 154(b) by 321 days.

(21) Appl. No.: 14/598,423

(22) Filed: Jan. 16, 2015

Related U.S. Application Data

(63) Continuation-in-part of application No. 29/446,846, filed on Feb. 27, 2013, now Pat. No. Des. 727,555.

(51) Int. Cl.

| | |
|---|---|
| ***A47B 19/00*** | (2006.01) |
| ***F21V 3/04*** | (2006.01) |
| ***F21V 17/10*** | (2006.01) |
| ***B42D 3/12*** | (2006.01) |
| *F21W 131/30* | (2006.01) |
| *B42F 7/06* | (2006.01) |
| *B42D 5/00* | (2006.01) |
| *B42D 1/00* | (2006.01) |
| *B42D 3/00* | (2006.01) |
| *B42D 12/00* | (2006.01) |

(52) U.S. Cl.
CPC ..... *F21V 3/049* (2013.01); *B42D 3/123* (2013.01); *F21V 17/10* (2013.01); *B42D 1/006* (2013.01); *B42D 3/00* (2013.01); *B42D 5/007* (2013.01); *B42D 12/00* (2013.01); *B42F 7/06* (2013.01); *F21W 2131/30* (2013.01)

(58) Field of Classification Search
CPC ..... B42D 12/00; B42D 5/007; B42D 1/006; B42D 3/123; B42D 3/00; B42D 3/12; B42F 7/06; A63H 33/38; F21V 3/049; F21W 2131/3005; F21W 2131/30333
USPC ..... D19/29; D9/634, 600; D99/37; D26/94
See application file for complete search history.

(56) References Cited

U.S. PATENT DOCUMENTS

| | | | | |
|---|---|---|---|---|
| 5,031,935 A * | 7/1991 | D'Andrea | ..... | B42D 1/004 281/15.1 |
| 7,163,306 B1 * | 1/2007 | Major | ..... | B42D 3/123 362/98 |
| 2005/0180809 A1 * | 8/2005 | Wu | ..... | B42D 3/123 402/70 |
| 2010/0109314 A1 * | 5/2010 | Stravinskas | ..... | A63H 33/38 281/38 |

* cited by examiner

*Primary Examiner* — Y M. Lee
(74) *Attorney, Agent, or Firm* — Steven A. Nielsen; www.NielsenPatents.com

(57) ABSTRACT

Disclosed book light embodiments 100 may include the construction of a flexible diffuser shade 200, flexible back binding system 300 contained and attached to a first back cover 400 and a second back cover 410. A book light may take the form of a closed book when not in use. When a light source is desired a book light may expand to open to any angle, all the way open to 360 degrees and expose a folded flexible diffuser shade 200. The first and second back covers may be opened in any position to accommodate a desired spread of the flexible diffuser shade. Magnets in the first and second back covers help to retain the back covers in a desired position and to mate or chain other book lights together.

3 Claims, 7 Drawing Sheets

BOOK LAMP WITH FLEXIBLE DIFFUSER SHADE

RELATED PATENT APPLICATION AND INCORPORATION BY REFERENCE

This is a utility application based upon and is a Continuation in Part of U.S. patent application Ser. No. 29/446,846 filed on Feb. 27, 2013. This related application is incorporated herein by reference and made a part of this application. If any conflict arises between the disclosure of the invention in this utility application and that in the related application, the disclosure in this utility application shall govern. Moreover, the inventor(s) incorporate herein by reference any and all patents, patent applications, and other documents hard copy or electronic, cited or referred to in this application.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION

(1) Field of the Invention

The invention generally relates to portable lighting systems. More particularly, the invention relates to the use of flexible diffuser shades integrated into books or other objects.

BRIEF SUMMARY OF THE INVENTION

The present invention overcomes shortfalls in the related art by presenting an unobvious and unique combination, configuration and use of a flexible diffuser shade, a flexible back binding system, magnets and other components to create a new lighting system that stores in the form of a book and operates in the form of an open book and opened flexible diffuser shade or system.

The known related art fails to disclose, suggest or teach the use of the disclosed flexible diffuser shade systems which may comprise a plurality of diffuser sheets attached at or near a longitudinal binding area. Each diffuser sheet may define and/or comprise a diffuser sheet void area used to maximize light reaching the outer surfaces of a flexible diffuser shade. A disclosed flexible diffuser shade may be comprised of a plurality of diffuser assemblies and each diffuser assembly may comprise a first sheet and a second sheet. First and second sheets or diffuser sheets may be attached and configured to form a top and bottom edge, an outer edge and inner edge. Diffuser assemblies may be attached to one another along diffuser assembly seams. Disclosed diffuser shade systems fold within book covers and artfully expand into a circular configuration to maximize light generated.

The disclosed embodiments include the use and construction of a new flexible back binding system that facilitates a closed position and an expanded position wherein the disclosed flexible diffuser shade is in a state of expansion. A flexible back binding system my comprise a plurality of longitudinal members, end caps, living hinges, a center horizontal support, lateral horizontal supports, an arch void, binding voids and other features and components.

Disclosed book lights may include light bulbs or other light sources, batteries or means of power storage and other features.

REFERENCE NUMERALS IN THE DRAWINGS

Figure 1:
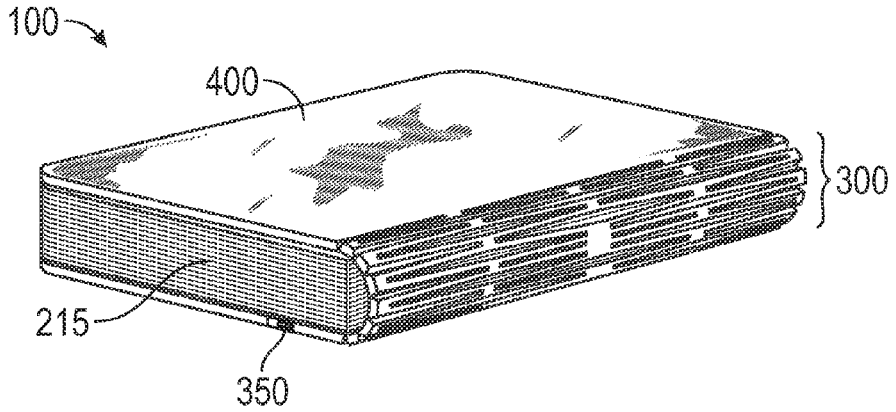
FIG. 1 depicts a perspective view of a book light in an expanded position

100 a disclosed book lamp in general
200 a flexible diffuser shade sometimes comprising a plurality of diffuser assemblies 230
210 outer edge surfaces of a flexible diffuser shade
215 top or bottom edge of a flexible diffuser shade
220 inner edge surfaces of a flexible diffuser shade
230 diffuser assembly comprising a first sheet 231 and a second sheet 233
231 a first sheet of a diffuser assembly 230
233 a second sheet of a diffuser assembly 230
235 inner connection point
236 diffuser assembly seam
237 outer edge section distal to inner connection point 235
240 a first diffuser sheet in a plan view
245 a second diffuser sheet in a plan view
250 a longitudinal binding area of a diffuser sheet
251 distal edge of longitudinal binding area 250 of a diffuser sheet
255 an arched or semi-circle boundary of a diffuser sheet
260 a diffuser sheet void defined within a diffuser sheet and by a longitudinal binding area 250 and semi-circle boundary 255
300 a flexible back binding system
310 a center horizontal support of the flexible back binding system 300
320 a lateral horizontal support of the flexible back binding system 300
330 an end cap created by end points of a plurality of longitudinal members 335
335 a longitudinal member of the flexible back binding system 300
337 binding void within the flexible binding system 300 defined by and between longitudinal members 335
340 living hinge defined by lateral horizontal supports 320 and end caps 330
350 micro USB port or other charging implement or orifice
360 arch void within flexible back binding system and inner edges 220 of a flexible diffuser shade

400 a first back cover
410 a second back cover
500 a first magnet
510 a second magnet
600 a first electronics board
610 a second electronics board
620 light bulbs These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

Referring to FIG. 1, a book lamp 100 is shown in a closed position and having a first back cover 400, a flexible back binding system 300, a flexible back biding system 300 and top or bottom edges 215 of flexible diffuser shade assemblies.

Figure 2:
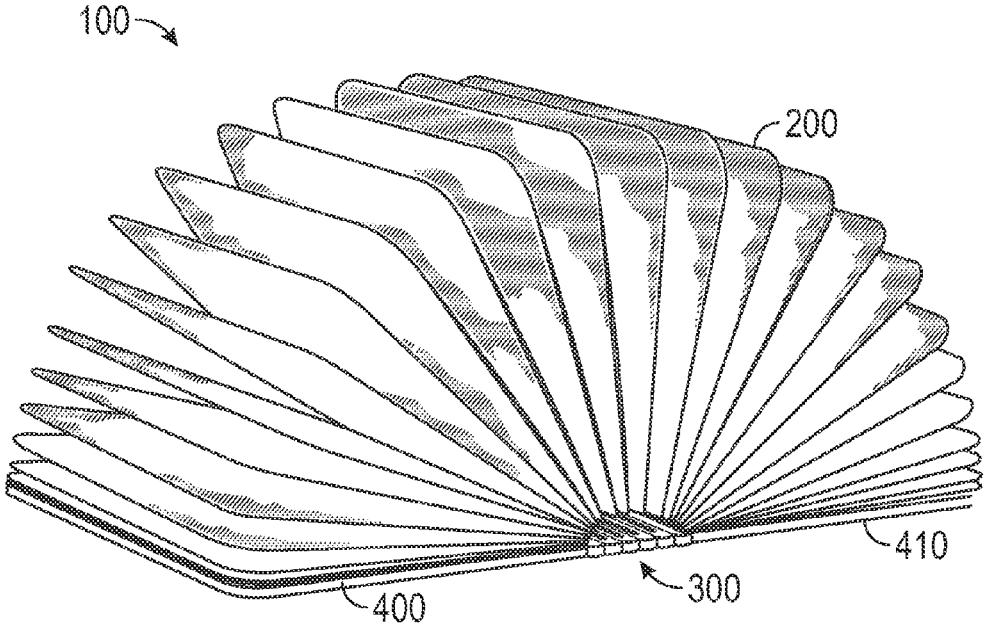
FIG. 2 depicts a perspective view of a book light in a folded or closed position

Referring to FIG. 2, a book lamp 100 is shown in an open or expanded position with a flexible diffuser shade 200 in an open position. A flexible back binding system 300 is connected to a first back cover 400 and a second back cover 410.

Figure 3:
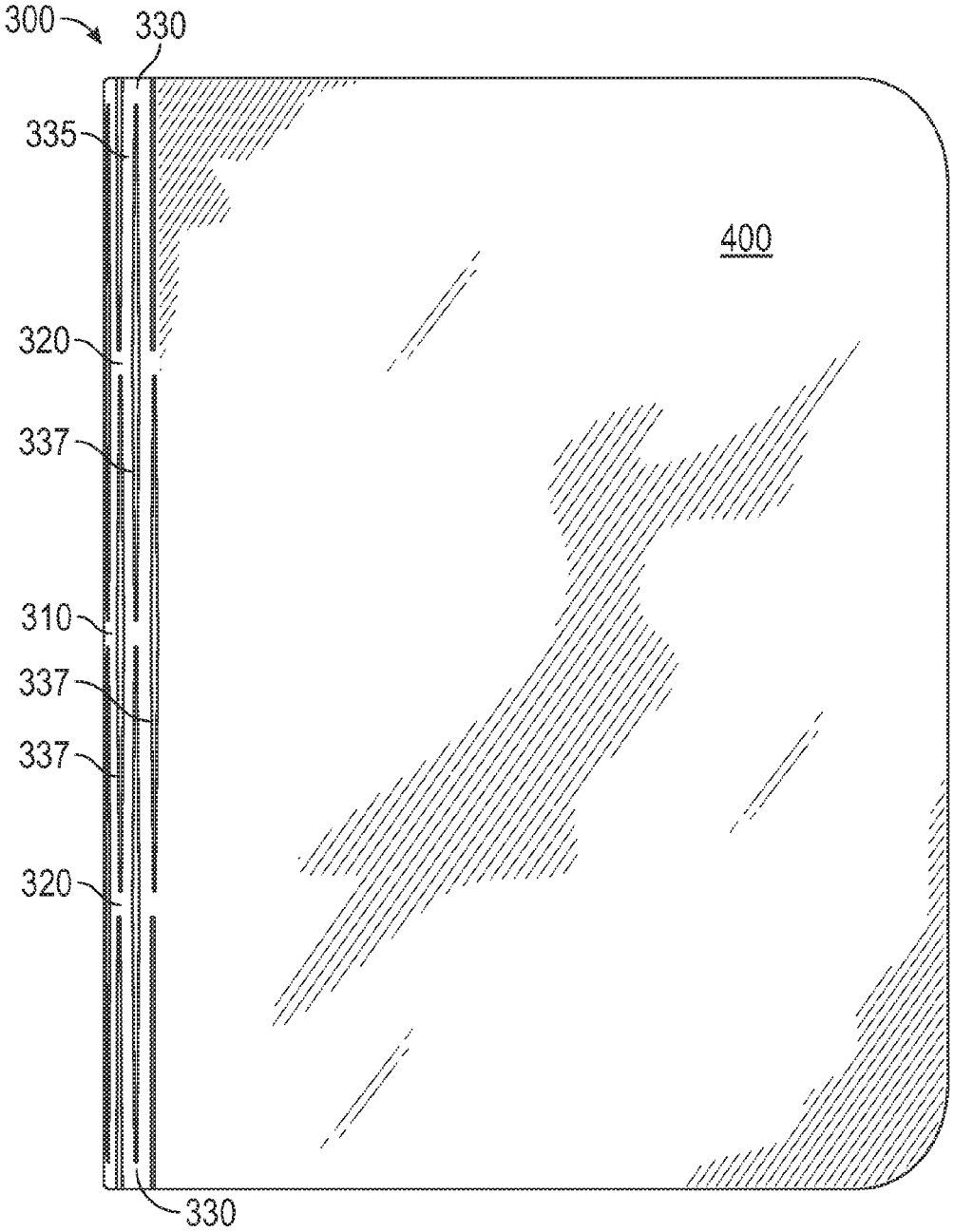
FIG. 3 depicts a side view of a book light
Figure 6:
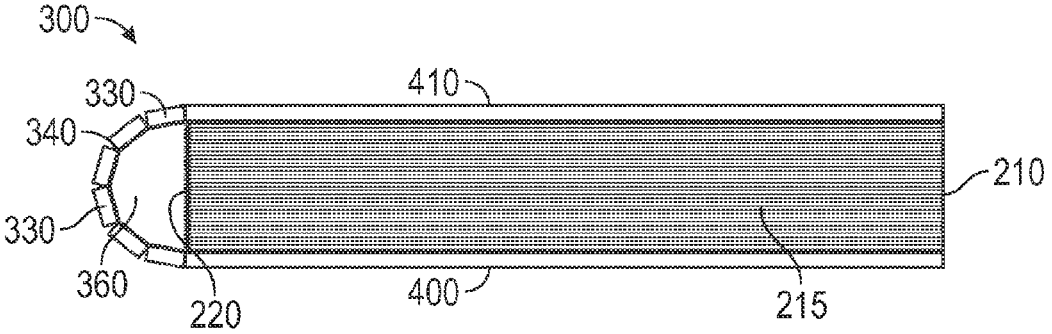
FIG. 6 depicts a top or bottom view of a book light in a closed position
Figure 7:
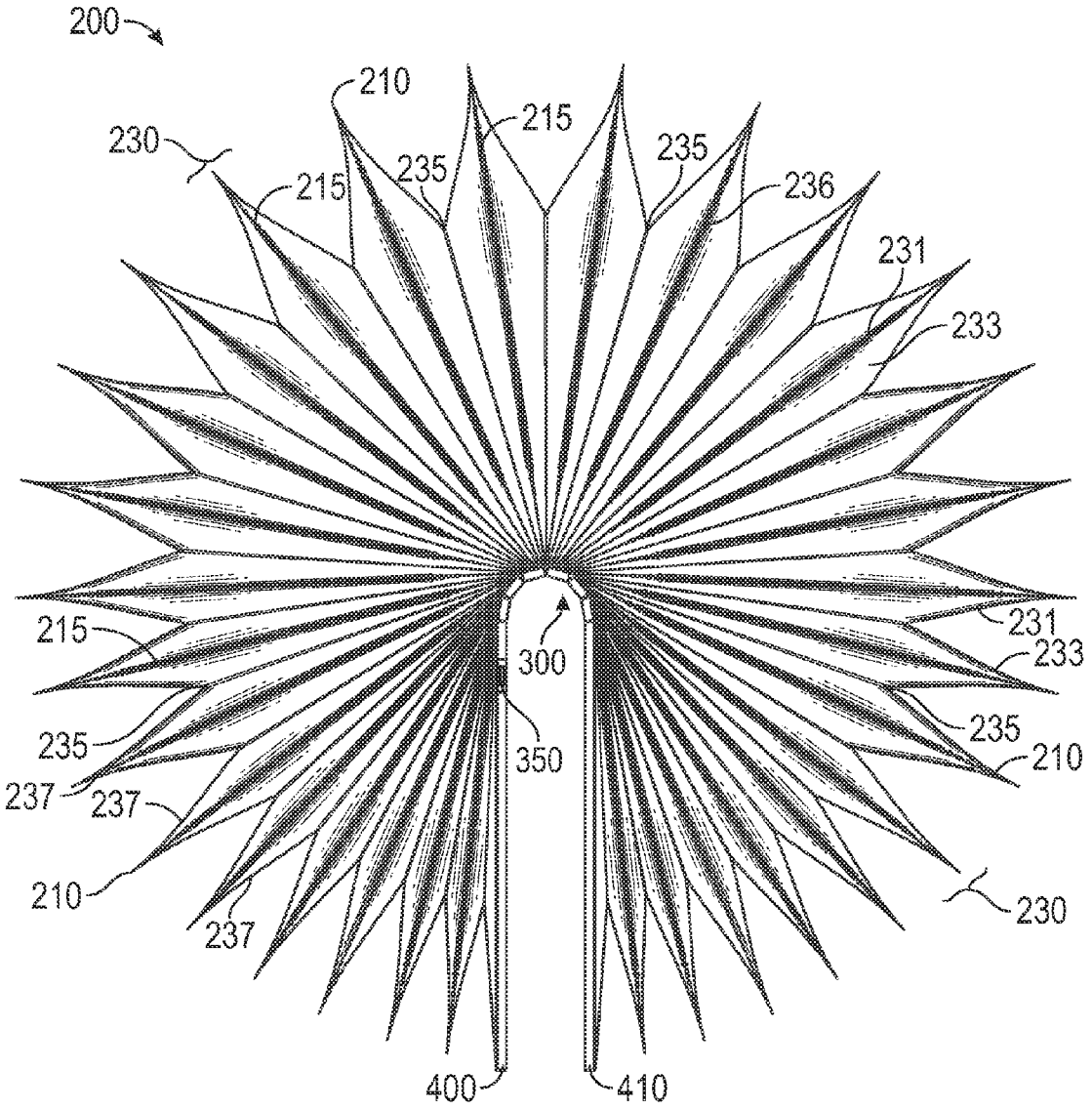
FIG. 7 depicts a top or bottom view of a book light in an open or expanded position
Figure 8:
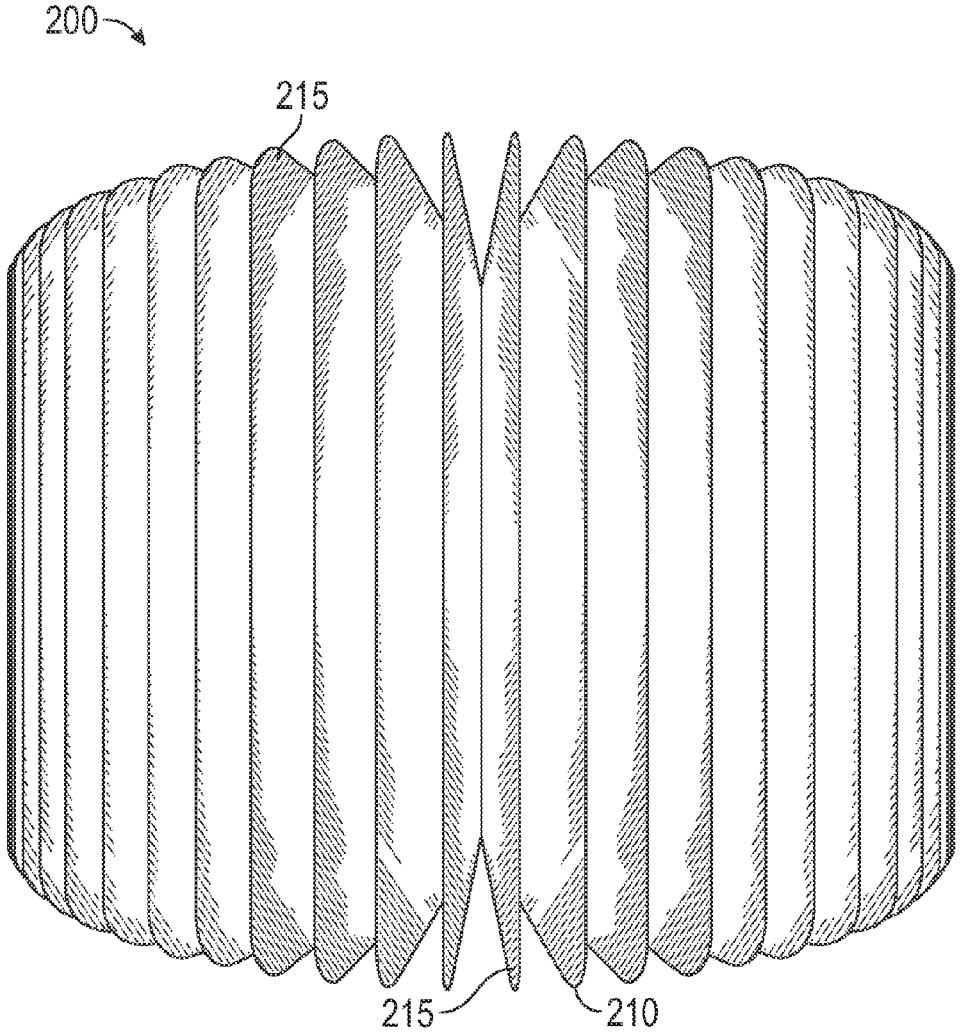
FIG. 8 depicts a flexible diffuser shade in an expanded or open position

Referring to FIG. 3, a flexible back binding system 300 is shown attached to a first back cover 400. A flexible back binding system 300 may comprise a plurality of end caps 330 with each end cap 330 comprising one or more longitudinal members 335. The longitudinal members 335 may define a plurality of binding voids 337. A flexible back binding system may further comprise a center horizontal support 310 and one or more lateral horizontal supports 320. The artful combination of the end caps 330, longitudinal members 335, binding voids 337, center horizontal support 310 and lateral horizontal supports 320 allow the flexible back binding system 300 to retain the first and second covers in a traditional closed book position and retain and position the first and second covers in an expanded position as shown in FIGS. 2, 7 and 8. The disclosed flexible back binding system 300 also allows for and/or creates an arch void 360 as shown in FIG. 6. The arch void 360 allows for a traditional book look while accommodating the expanded positions shown in FIGS. 2, 7 and 8.

Figure 4:
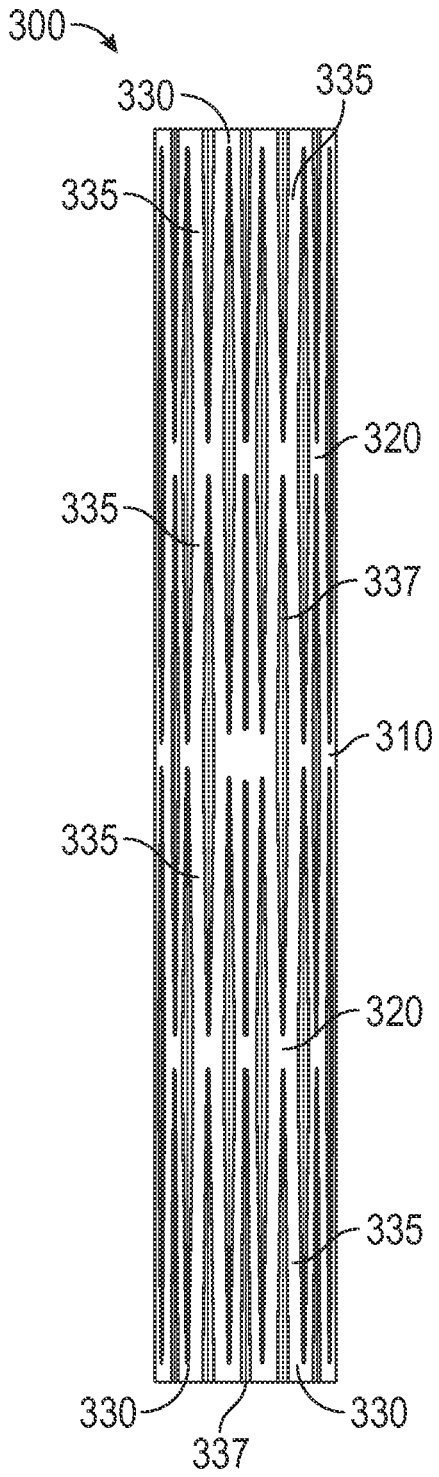
FIG. 4 depicts a plan view of a flexible binding component

Referring to FIG. 4, a flexible back binding system 300 is shown in a plan or elevation view and may comprise a plurality of longitudinal members 335 with the distal ends of the longitudinal members comprising a plurality of end caps 330. End caps 330 and/or longitudinal members 335 may define a plurality of binding voids 337. The combination of longitudinal members 335, binding voids 337 and/or other disclosed features allow the flexible back binding system to accommodate a closed book position and open positions wherein a flexible diffuser shade may be expanded and may produce diffused light. A center horizontal support 310 and one or more lateral horizontal supports may add extra rigidity to the flexible back binding system 300. Distal binding voids 337 may assist in the rotation and variable positioning of the end caps 330.

Figure 5:
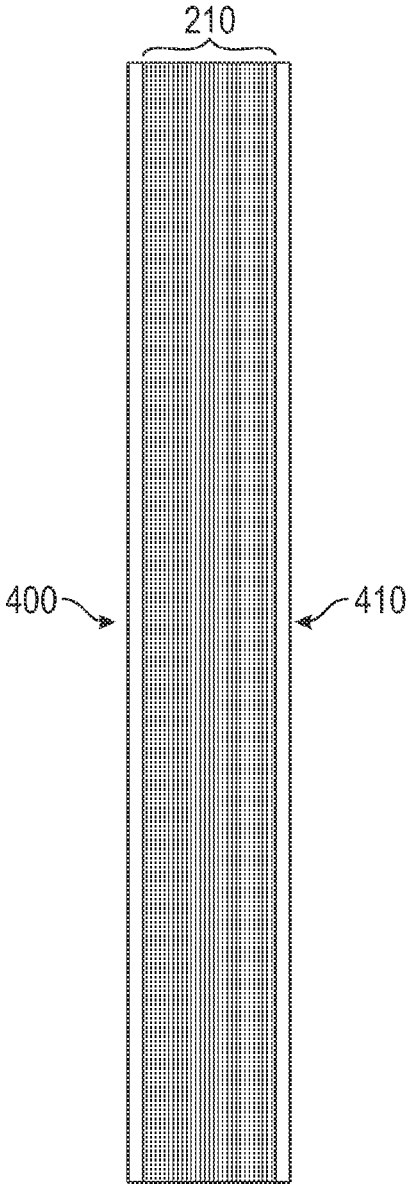
FIG. 5 depicts a plan view of diffuser or diffusion pages in a closed position

Referring to FIG. 5, a first book cover 400 and a second book cover 410 are shown in a plan or elevation view. Outer edge surfaces 210 of a flexible diffuser shade are also shown.

Referring to FIG. 6 depicts a side or elevation view of a book light in a closed position. A first back cover 400 and a second back cover 410 are attached to a flexible back binding system 300. Inner edge surfaces 220 of a flexible diffuser shade define a straight edge and part of an arch void 360. The inner surfaces of the back binding system also define areas of the arch void 360. FIG. 6 depicts outer edge surfaces 210 of a flexible diffuser shade and a top or bottom edge 215 of a flexible diffuser shade. A flexible back binding system 300 may include a plurality of end caps 300 and living hinges 340. Living hinges may be defined by or created by end caps 300 and or longitudinal members.

FIG. 7 depicts a first back cover 400 and a second back cover 410 attached to a flexible diffuser shade 200. A flexible back binding system 300 is attached or hingedly attached to the first back cover 400 and second back cover 410. A flexible diffuser shade 200 may comprise a plurality of diffuser assemblies 230. Each diffuser assembly 230 may comprise a first sheet 231 and a second sheet 233. A first sheet 231 and a second sheet 233 may be attached to form a top or bottom edge 215 and an outer edge 210. Near the distal end of a diffuser assembly, two diffuser assemblies may connect at an inner connection point 235. The two connected diffuser assemblies may further define and include outer edge sections 237 which may start at a connection point 235 and terminate at an outer edge surface 210. Two connected diffuser assemblies may be attached at or along diffuser assembly seams 236.

FIG. 8 depicts a flexible diffuser shade 200 in an open position and shows top or bottom edges 215 and outer edge surfaces 210.

Figure 9:
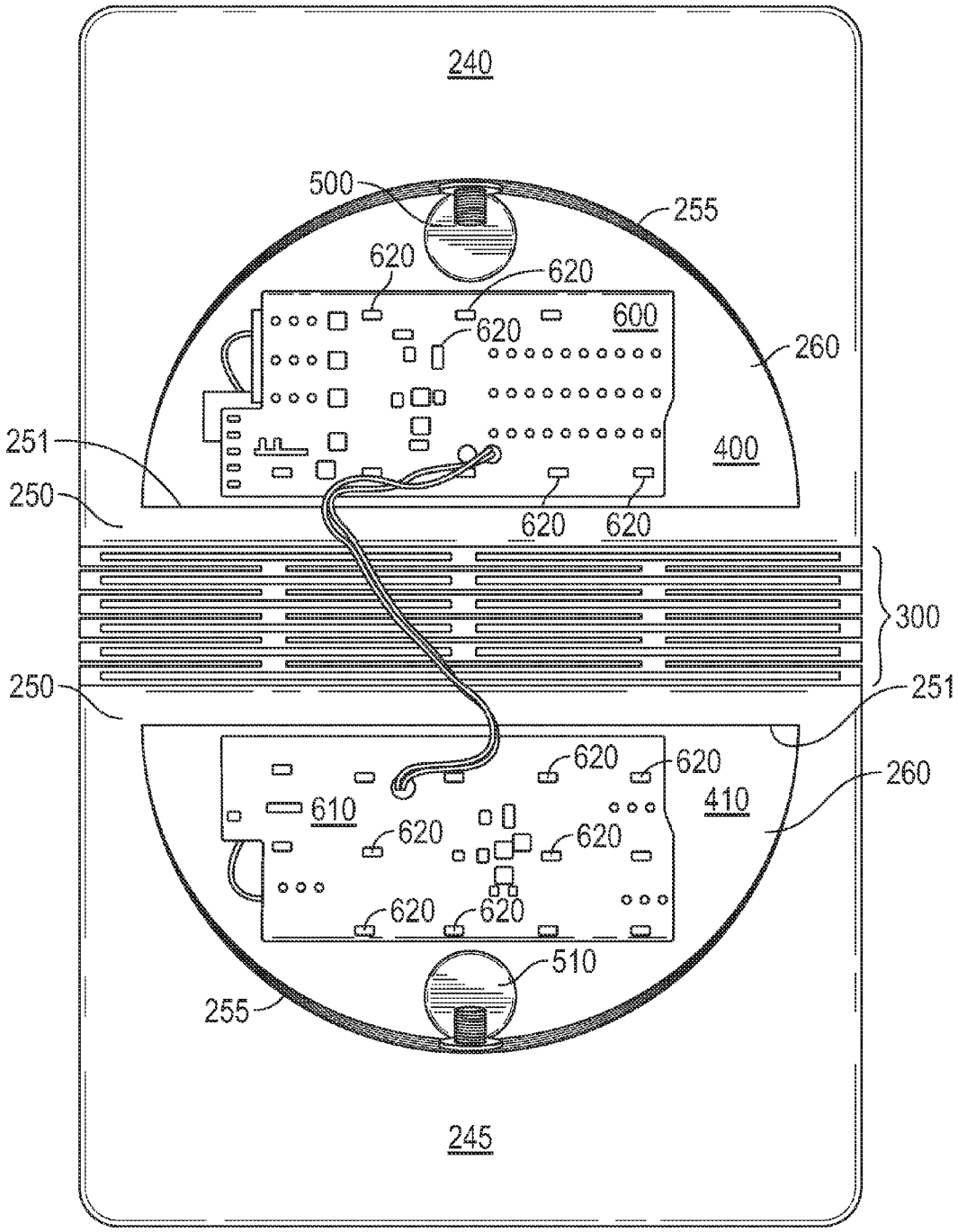
FIG. 9 depicts inner sides of a book light

FIG. 9 depicts a flexible back binding system 300 connected to a first back cover 400 and a second back cover 410. A first back cover 400 may be attached to a first diffuser sheet 240 and a second back cover 410 may be attached to a second diffuser sheet 245. Diffuser sheets in general may take the shape of the first and second diffuser sheets. Diffuser sheets may take the form of first sheet of a diffuser assembly or a second sheet of a diffuser assembly. Diffuser sheets may include a longitudinal binding area 250 attached to an inner edge surface section 220 (as shown in FIG. 6) Longitudinal binding areas 250 may be attached to one another to secure diffuser sheets.

A diffuser sheet may include a diffuser sheet void 260 defined by a distal edge 251 of a longitudinal binding area 250 and an arched or semi-circle boundary 255 of a diffuser sheet. The diffuser sheet void 260 enhances the ability of a book light to disperse light though or within a plurality of diffuser sheets or a flexible diffuser shade.

A first back cover 400 may include a first magnet 500 and a first electronics board while a second back cover 410 may include a second magnet 510 and a second electronics board 610. Either electronics board or either back cover may include a light source. The magnets assist in retaining the book light in either a closed or open position. The disclosed magnets also assist in chaining together a plurality of book lights.

The first electronics board 610 and the second electronics board 620 may each comprise a plurality of lamps or lights 620. The lights 620 may be LED or other implements of light generation. The placement of the lights 620 within the boundary 255 of the diffuser sheets or within the diffuser sheet void 260 provides exceptional results in illumination as light travels from the inside of the sheets to the outside of the sheets and as the lights are strategically attached to electronics boards located upon the book covers.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

Items

Disclosed embodiments may include but are not limited to the following items.

Item 1. A book lamp 100 comprising:

a) a first back cover 400 and a second back cover 410 attached to a flexible back binding system 300;

b) a flexible diffuser shade attached 200 attached to the first back cover and the second back cover;

c) a light source attached to either the first cover or the second cover.

Item 2. The book lamp of item 1 wherein the flexible diffuser shade comprises a first diffuser sheet 240 attached to the first back cover and a second diffuser sheet attached to the second back cover.

Item 3. The book lamp of item 2 wherein the first and second diffuser sheets comprise a longitudinal binding area 250 and the longitudinal binding area comprises a distal edge 251.

Item 4. The book lamp of item 3 wherein the first and second diffuser sheets comprise a diffuser sheet void 260 defined by the distal edge of the longitudinal binding area and an arched boundary 255 of the diffuser sheets.

Item 5. The book lamp of item 4 wherein the flexible diffuser shade further comprises a plurality of additional diffuser sheets of the same configuration of the first and second diffuser sheets, the additional diffuser sheets attached to each other and the first and second diffuser sheets at the longitudinal binding area.

Item 6. The book lamp of item 5 wherein the flexible back binding system comprises a plurality of longitudinal members 335, a plurality of binding voids 227 defined between the longitudinal members, end caps 330, the end caps located at distal ends of the longitudinal members and a center horizontal support 310.

Item 7. The book lamp of item 6 where the flexible back binding system further comprises a plurality of lateral horizontal supports 320.

Item 8. The book lamp of item 7 wherein the flexible back binding system further comprise a plurality of living hinges created by the lateral horizontal supports and the longitudinal members.

Item 9. The book lamp of item 8 wherein the flexible diffuser shade further comprises a plurality of diffuser assemblies 230 with each diffuser assembly comprising a first sheet 231 and a second sheet 233.

Item 10. The book lamp of item 9 wherein the first and second sheet of each diffuser assembly comprise a top and bottom edge 215 and an outer edge 210.

Item 11. The book lamp of item 10 wherein the diffuser assemblies attach to each other along a diffuser assembly seam 236.

Item 12. The book lamp of item 11 wherein each diffuser assembly seam terminates at an inner connection point 235.

What is claimed is:

1. A book lamp comprising:

a) a first back cover and a second back cover attached to a flexible back binding system;

b) a flexible diffuser shade comprising a plurality of diffuser assemblies, one of the diffuser assemblies comprising a first diffuser sheet attached to the first back cover and a second diffuser sheet attached to the second back cover; and c) a light source attached to either the first cover or the second cover;

wherein the first and second diffuser sheets comprise of a top edge, a bottom edge, an outer edge, a longitudinal binding area, and the longitudinal binding area comprising a distal edge;

wherein the first and second diffuser sheets comprise a diffuser sheet void defined by the distal edge of the longitudinal binding area and an arched boundary of the diffuser sheets;

wherein the other plurality of diffuser assemblies, of the same configuration of the first and second diffuser sheets, are attached to each other along a diffuser assembly seam, and at the longitudinal binding area;

wherein each diffuser assembly seam terminates at an inner connection point;

wherein the flexible back binding system comprises a plurality of longitudinal members, a plurality of binding voids defined between the longitudinal members, end caps, the end caps located at distal ends of the longitudinal members and a center horizontal support disposed between two or more binding voids.

2. The book lamp of claim 1 wherein the flexible back binding system further comprises a plurality of lateral horizontal supports disposed on the longitudinal members and between the plurality of binding voids.

3. The book lamp of claim 2 wherein the flexible back binding system further comprise a plurality of living hinges created by the lateral horizontal supports and the longitudinal members.

* * * * *